US011640886B2

(12) United States Patent
Schoonenberg et al.

(10) Patent No.: US 11,640,886 B2
(45) Date of Patent: May 2, 2023

(54) CIRCUIT BREAKER

(71) Applicant: Eaton Intelligent Power Limited, Dublin (IE)

(72) Inventors: Gerard Cornelis Schoonenberg, Hengelo (NL); Martin Bernardus Johannes Leusenkamp, Suzhou (CN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/626,815

(22) PCT Filed: Jun. 30, 2020

(86) PCT No.: PCT/EP2020/068347
§ 371 (c)(1),
(2) Date: Jan. 13, 2022

(87) PCT Pub. No.: WO2021/008866
PCT Pub. Date: Jan. 21, 2021

(65) Prior Publication Data

US 2022/0293368 A1 Sep. 15, 2022

(30) Foreign Application Priority Data

Jul. 16, 2019 (GB) ..... 1910149

(51) Int. Cl.
*H01H 33/662* (2006.01)
*H01H 33/664* (2006.01)
*H01H 33/666* (2006.01)

(52) U.S. Cl.
CPC ..... *H01H 33/664* (2013.01); *H01H 33/662* (2013.01); *H01H 33/666* (2013.01)

(58) Field of Classification Search
CPC .. H01H 33/664; H01H 33/662; H01H 33/666; H01H 33/66; H01H 33/6662; H01H 2033/6648; H01H 2001/0205
(Continued)

(56) References Cited

U.S. PATENT DOCUMENTS 5,912,604 A * 6/1999 Harvey ..... H01H 33/6662 218/138
6,870,451 B1 * 3/2005 Inoue ..... H01H 33/6662 335/238

(Continued)

FOREIGN PATENT DOCUMENTS

EP 2851919 A1 3/2015
EP 2947676 A1 11/2015

(Continued)

*Primary Examiner* — William A Bolton
(74) *Attorney, Agent, or Firm* — Leydig, Voit & Mayer, Ltd.

(57) ABSTRACT

A circuit breaker for use in medium voltage applications includes: a housing; a first contact arranged on an end of a first contact stem that extends fixedly through the housing; a second contact arranged on an end of a second contact stem that extends axially and is movable through the housing. The circuit breaker further includes a moving device for moving the second contact between a closed position in contact with the first contact and an open position spaced apart from the first contact. A mass of the second contact is less than a mass of the first contact. The moving device includes a closing mechanism for urging the second contact to the closed position and an opening mechanism for urging the second contact to the open position. The circuit breaker further includes a reconditioning power source and a controller for providing a reconditioning current.

9 Claims, 2 Drawing Sheets

(58) Field of Classification Search
USPC ..... 218/118, 120, 140, 141, 144, 145, 153, 218/154
See application file for complete search history.

(56) References Cited

U.S. PATENT DOCUMENTS

| | | | | |
|---|---|---|---|---|
| 8,941,960 | B2 * | 1/2015 | Murray | H01H 75/06 361/72 |
| 9,183,996 | B2 * | 11/2015 | Karlström | H01H 33/6662 |
| 9,905,348 | B2 * | 2/2018 | Kim | H01F 7/081 |
| 2010/0320063 | A1 * | 12/2010 | Takahara | H01H 3/60 200/50.25 |
| 2012/0274428 | A1 * | 11/2012 | Reuber | H01H 33/6662 335/6 |
| 2014/0167889 | A1 | 6/2014 | Einschenk et al. | |
| 2015/0332884 | A1 * | 11/2015 | Lee | H01H 33/66 361/42 |
| 2018/0254159 | A1 | 9/2018 | Shi et al. | |

FOREIGN PATENT DOCUMENTS

| | | | |
|---|---|---|---|
| GB | 342615 | A | 2/1931 |
| GB | 1168612 | A | 10/1969 |
| JP | 08111149 | A | 4/1996 |
| KR | 20170090928 | A | 8/2017 |
| WO | WO 2019022659 | A1 | 1/2019 |

* cited by examiner

CIRCUIT BREAKER

CROSS-REFERENCE TO PRIOR APPLICATIONS

This application is a U.S. National Phase application under 35 U.S.C. § 371 of International Application No. PCT/EP2020/068347, filed on Jun. 30, 2020, and claims benefit to British Application No. GB 1910149.2, filed on Jul. 16, 2019. The International Application was published in English on Jan. 21, 2021 as WO 2021/008866 under PCT Article 21(2).

FIELD

The invention relates to a circuit breaker, such as a vacuum interrupter, for use in medium voltage applications, which circuit breaker comprises:

a housing;

a first contact arranged on an end of a first contact stem, which first contact stem extends fixedly through the housing;

a second contact arranged on an end of a second contact stem, which second contact stem extends axially movable through the housing;

a moving device for moving the second contact between a closed position in contact with the first contact and an open position spaced apart from the first contact, wherein the mass of the second contact is less than the mass of the first contact.

BACKGROUND

Such a circuit breaker is for example known from GB 342615. This publication discloses a vacuum interrupter wherein the second, movable contact has a different design than the first, stationary contact. The first and second contacts are asymmetric. GB 342615 describes that the mass of the second, movable contact is kept low in order to achieve a great increase in switching speed.

Although reducing the mass of the second, movable contact decreases the inertia of the contact and therefore allows for very fast opening of the contacts of the circuit breaker, the reduced mass also has the disadvantage of an increase in the so-called bouncing effect when closing the contacts.

Typically for DC applications a very fast opening of the contacts is desired to reduce arcing and as a result wear of the contacts. However, when the movable, second contact is moved at the same high speed to the closed position, the impact of the low mass second contact on the fixed, high mass first contact will cause the low mass second contact to bounce off from the first contact. This bouncing effect will be repeated a number of times until the second contact is in full contact with the first contact.

SUMMARY

In an embodiment, the present invention provides a circuit breaker for use in medium voltage applications, which circuit breaker comprises: a housing; a first contact arranged on an end of a first contact stem, which first contact stem extends fixedly through the housing; a second contact arranged on an end of a second contact stem, which second contact stem extends axially movable through the housing; and a moving device configured to move the second contact between a closed position in contact with the first contact and an open position spaced apart from the first contact, wherein a mass of the second contact is less than a mass of the first contact, wherein the moving device comprises a separate closing mechanism configured to urge the second contact to the closed position and a separate opening mechanism configured to urge the second contact to the open position, wherein the circuit breaker further comprises a reconditioning power source and a controller configured to provide, in a reconditioning mode of the circuit breaker, a reconditioning current from the reconditioning power source to the first contact and the second contact, and wherein the first contact comprises an anode and the second contact comprises a cathode.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
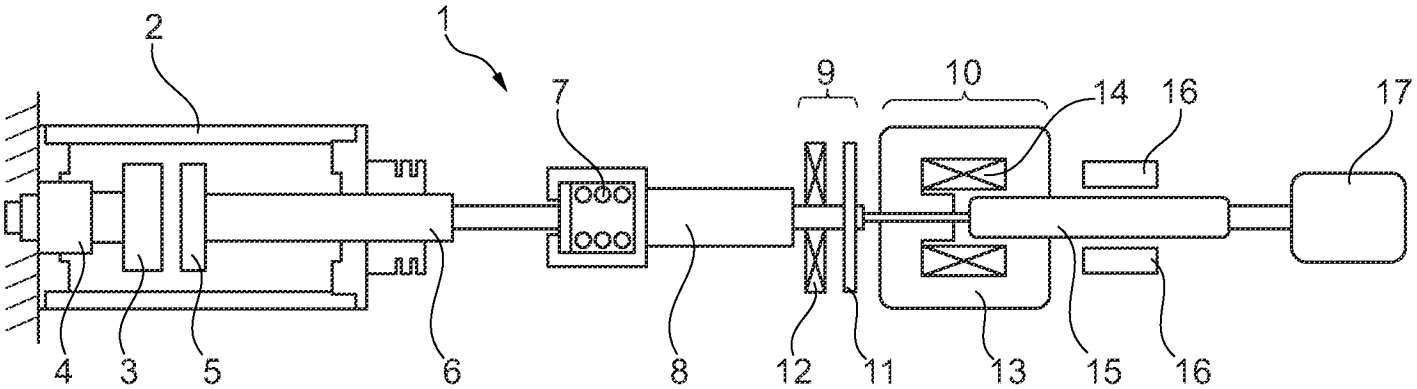
FIG. 1 shows a schematic view of a first embodiment of a circuit breaker according to the invention.

In an embodiment, the present invention provides reduces or even removes the above mentioned disadvantages.

In an embodiment, the present invention provides a circuit breaker which is characterized in that the moving device comprises a separate closing mechanism for urging the second contact to the closed position and a separate opening mechanism for urging the second contact to the open position.

By using two separate mechanisms for moving the second contact, it is possible to control the speed of the second contact more accurately. The opening mechanism can be designed for a fast opening of the second contact making optimal use of the low mass of the second contact, while the closing mechanism can be designed for a slower closing of the second contact, such that the bouncing effect is minimized.

Using two separate mechanism allows for a mechanical separation of the opening action and the closing action. This allows for a mechanism to be designed and optimized solely for the opening action and another mechanism to be designed and optimized solely for the closing action.

Preferably, the closing mechanism is an electro-mechanical drive mechanism and the opening mechanism comprises a Thomson coil actuator.

A Thomson coil actuator allows for a very quick acceleration of the second contact from the closed position to the open position. This is achieved by using induction forces generating by applying a current to a coil, which will then expel the second contact. These induction forces can easily be increased simply by increasing the current.

The closing mechanism is embodied in a more conventional way with an electro-mechanical drive mechanism, such as a motor and spring mechanism. This allows for a slower, more controlled closing of the second contact and reduction or even removal of the bouncing effect.

The Thomson coil actuator is an optimized mechanism for the opening action, while the electro-mechanical drive mechanism is an optimized mechanism for the closing action.

It must be understood that apart of the Thomson drive and the electro-mechanical drive mechanism other mechanisms could also be used and can be optimal depending on the specific requirements for the circuit breaker.

In a preferred embodiment of the circuit breaker according to the invention the closing mechanism, the opening mechanism and the movable contact are coupled in series and wherein the opening mechanism is adjacent to the movable contact.

By arranging both mechanisms in series with the movable contact, a compact drive of the movable contact is obtained, which compact drive can easily be applied in present designs of switching gear.

In a further preferred embodiment of the circuit breaker according to the invention the spring is arranged between the opening mechanism and the closing mechanism.

The spring allows for the opening mechanism to open quickly without the need to also move the closing mechanism at the same speed. The spring provides a compensation, such that the closing mechanism can have lag with respect to the opening speed of the opening mechanism.

In another preferred embodiment a damper is coupled to the moving part of the closing mechanism.

The damper ensures that any tendency of the opening mechanism, which can be directly coupled to the closing mechanism, does not bounce back.

In yet another preferred embodiment of the circuit breaker according to the invention, the first contact is the cathode.

When the second contact of the circuit breaker is moved to the open position, arcing will typically occur, where the plasma of the arc is generated on the cathode. As the first contact has more mass than the second contact, it is of advantage to have the first contact as the cathode, especially in DC applications of the circuit breaker according to the invention. The erosion of the first contact due to the generation of the plasma has a less destructive effect on the first contact as more mass is available, then when the erosion would take place on the second contact, which is typically designed for light weight and fast movement.

Figure 3:
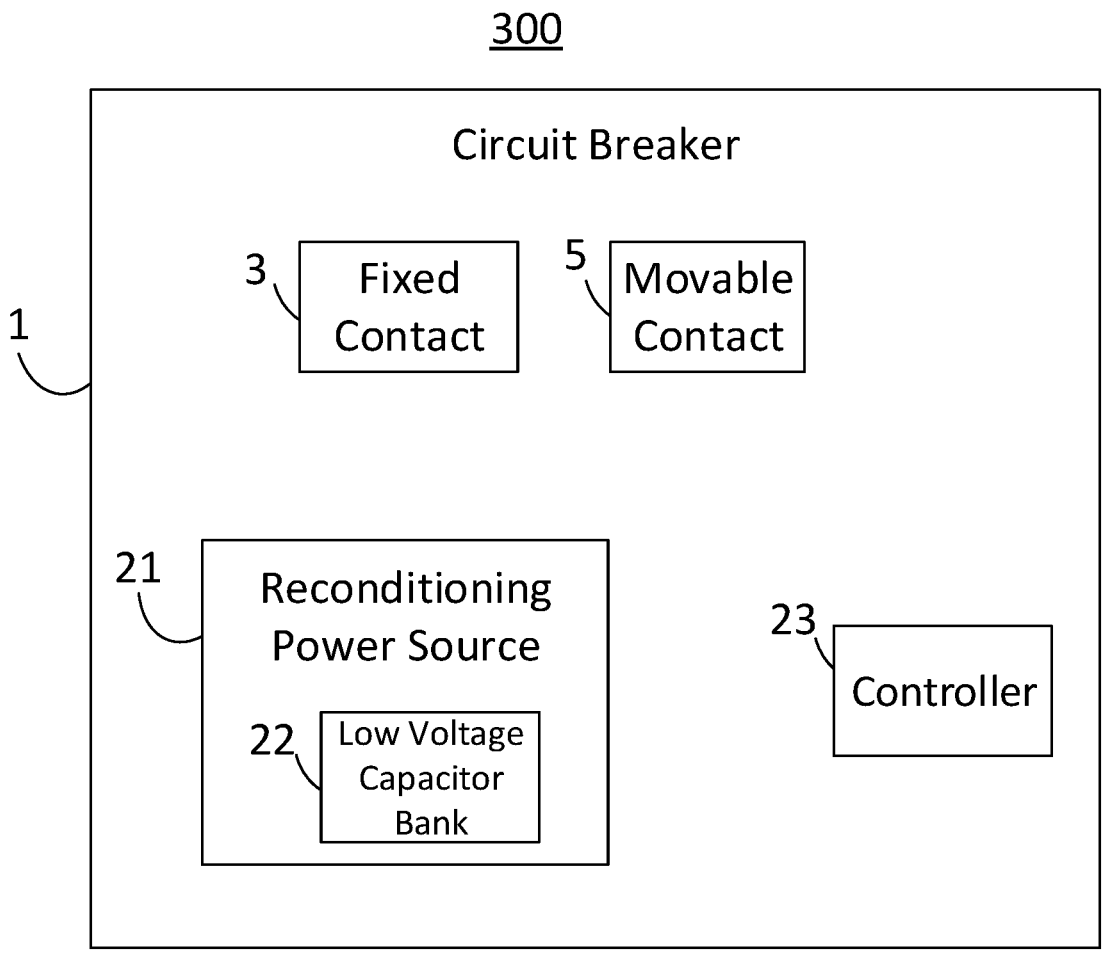
FIG. 3 shows a schematic view of a third embodiment of a circuit breaker, a reconditioning power source, and a controller according to the invention.

Yet a further preferred embodiment of the circuit breaker according to the invention further comprising a reconditioning power source 21, such as a low voltage capacitor bank 22, and a controller 23 for providing, in a reconditioning mode of the circuit breaker, a reconditioning current from the reconditioning power source 21 to the first and second contact, wherein the first contact is the anode and the second contact is the cathode is shown in FIG. 3.

Although plasma generated on the first contact, which has a greater mass, has a less destructive effect, the particles of the plasma will be deposited onto the second contact. These particles will increase the weight of the second contact after each opening of the circuit breaker. After a number of openings of the circuit breaker, the increase in weight will reduce the speed of the second contact upon opening to such an extent, that the short circuit current in the system, which is to be stopped by opening the circuit breaker, reaches levels, which are not desirable.

By providing a reconditioning power source 21 and by reversing the current through the contacts, a plasma can be generated on the second, movable contact, such that the excess of particles, which increase the weight of the second contact, are deposited back onto the first contact.

With this embodiment, the controller can ensure that after a number of openings of the circuit breaker, the circuit breaker is brought into a reconditioning mode and that current from the reconditioning power source 21 is transferred in reverse direction through the contacts.

FIG. 1 shows a circuit breaker 1 according to the invention. The circuit breaker 1, in particular a vacuum interrupter, has a housing 2 with a fixed contact 3 arranged on a contact stem 4 and a movable contact 5 arranged on a movable contact stem 6.

The circuit breaker 1 has outside of the housing 2 a spring 7 to maintain contact pressure when the contacts 3, 5 are closed.

An insulating rod 8 connects the spring 7 with the opening mechanism 9, which is in series connected with the closing mechanism 10.

The opening mechanism 9 is a Thomson coil having a copper disc 11 and a coil 12, which generates a repulsing force onto the disc 11 when provided with current.

The closing mechanism 10 is an electromagnetic actuator, which has a core 13 of magnetizable material, in which a coil 14 is arranged. The operating rod 15 extending through the core 13 is also of magnetizable material, such that on providing a current the coil 14, the operating rod 15 is pulled into the core 13, which will bring the contacts 3, 5 together.

In order to hold the circuit breaker either in open or in closed position, permanent magnets 16 are arranged around the operating rod 15 of magnetizable material.

Finally a damper 17 is provided to dampen any tendency of the circuit breaker to bounce back especially at the opening movement.

Figure 2:
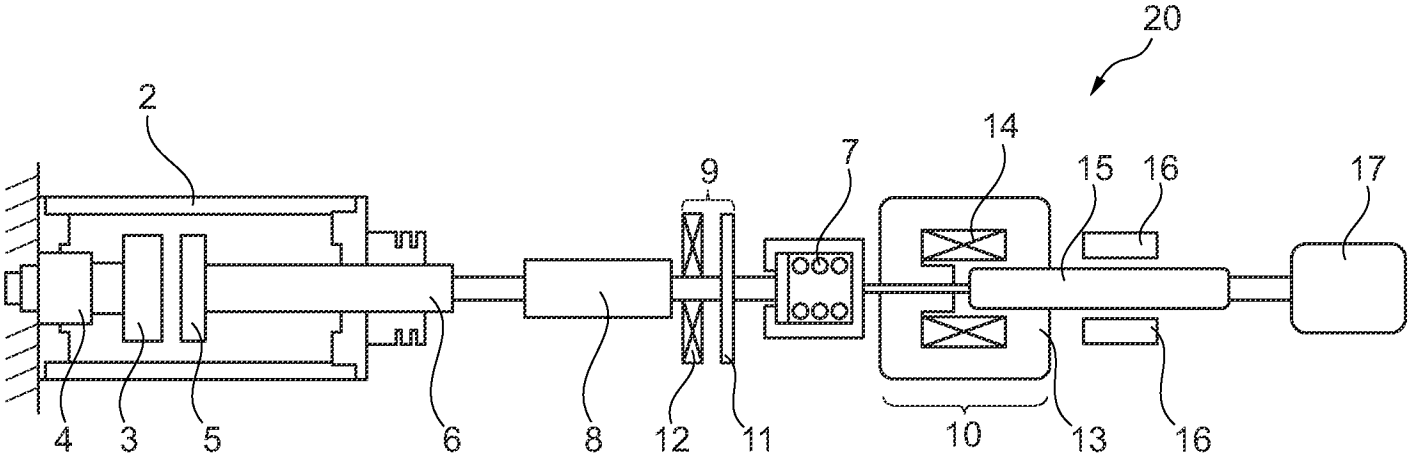
FIG. 2 shows a schematic view of a second embodiment of a circuit breaker according to the invention.

FIG. 2 shows an alternative of a circuit breaker 20 according to the invention. The circuit breaker corresponds largely with the circuit breaker of FIG. 1 and the same features are designated with the same reference signs.

The difference of the circuit breaker 20 is that the insulating rod 8 is directly coupled to the moving contact 5 and the Thomson coil 9 is directly coupled to the insulating rod 8. As a result the spring 7 is arranged between the opening mechanism 9 and the closing mechanism 10. This ensures that the fast movement of the opening mechanism 9 is less impeded by the inertia of the closing mechanism 10.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A circuit breaker for use in medium voltage applications, wherein the circuit breaker comprises:

a housing;

a first contact arranged on an end of a first contact stem, which first contact stem extends fixedly through the housing;

a second contact arranged on an end of a second contact stem, which second contact stem extends axially movable through the housing; and a moving device for moving the second contact between a closed position in contact with the first contact and an open position spaced apart from the first contact, wherein a mass of the second contact is less than a mass of the first contact, wherein the moving device comprises a separate closing mechanism for urging the second contact to the closed position and a separate opening mechanism for urging the second contact to the open position, wherein the circuit breaker further comprises a reconditioning power source and a controller, for providing, in a reconditioning mode of the circuit breaker, a reconditioning current from the reconditioning power source to the first contact and the second contact, and wherein the first contact comprises an anode and the second contact comprises a cathode.

2. The circuit breaker according to claim 1, wherein the closing mechanism comprises an electro-mechanical drive mechanism, and wherein the opening mechanism comprises a Thomson coil actuator.

3. The circuit breaker of claim 1, wherein the closing mechanism, the opening mechanism, and the movable contact are coupled in series, and wherein the opening mechanism is adjacent to the movable contact.

4. The circuit breaker of claim 3, wherein a spring is arranged between the opening mechanism and the closing mechanism.

5. The circuit breaker of claim 3, wherein a damper is coupled to the moving device of the closing mechanism.

6. The circuit breaker according to claim 1, wherein the circuit breaker comprises a vacuum interrupter.

7. The circuit breaker according to claim 1, wherein the reconditioning power source comprises a low voltage capacitor bank.

8. A circuit breaker according to claim 1, wherein the circuit breaker is a vacuum interrupter.

9. A circuit breaker for use in medium voltage applications, wherein the circuit breaker comprises:

a housing;

a first contact arranged on an end of a first contact stem, which first contact stem extends fixedly through the housing;

a second contact arranged on an end of a second contact stem, which second contact stem extends axially movable through the housing; and a moving device for moving the second contact between a closed position in contact with the first contact and an open position spaced apart from the first contact, wherein a mass of the second contact is less than a mass of the first contact, wherein the moving device comprises a separate closing mechanism for urging the second contact to the closed position and a separate opening mechanism for urging the second contact to the open position, wherein the circuit breaker further comprises a reconditioning power source, for providing, in a reconditioning mode of the circuit breaker, a reconditioning current from the reconditioning power source to the first contact and the second contact, and wherein the first contact comprises a cathode and the second contact comprises an anode.

* * * * *